US005639233A

United States Patent [19]

Ruark et al.

[11] Patent Number: 5,639,233

[45] Date of Patent: Jun. 17, 1997

[54] KILN CONSTRUCTION AND METHOD OF FIRING THE SAME

[76] Inventors: Ralph E. Ruark, 9 Lilac La., Medford, N.J. 08055; Francis X. Petrus, 2741 Country La., Langhorne, Pa. 19047

[21] Appl. No.: 499,748

[22] Filed: Jul. 7, 1995

[51] Int. Cl.[6] ..... F27B 9/12

[52] U.S. Cl. ..... 432/18; 432/24; 431/1

[58] Field of Search ..... 432/18, 24; 431/12, 431/1

[56] References Cited

U.S. PATENT DOCUMENTS

| | | | |
|---|---|---|---|
| 3,051,462 | 8/1962 | Fennell | 432/24 |
| 3,055,652 | 9/1962 | Remmey et al. . | |
| 3,158,364 | 11/1964 | Cremer et al. . | |
| 3,485,900 | 12/1969 | Cremer et al. . | |
| 3,584,849 | 6/1971 | Cremer et al. . | |
| 3,969,069 | 7/1976 | Knaak . | |
| 4,473,348 | 9/1984 | Tikhonovich et al. | 431/1 |
| 4,480,992 | 11/1984 | Okamoto | 432/18 |
| 4,834,644 | 5/1989 | Snow . | |
| 4,993,938 | 2/1991 | Thrasher et al. . | |
| 5,000,102 | 3/1991 | Ho . | |
| 5,052,917 | 10/1991 | Saito et al. . | |
| 5,176,086 | 1/1993 | Clark et al. . | |

OTHER PUBLICATIONS

"Pulse Firing, A Concept For Burner Control", John A. Marino, Hauck Manufacturing Company–1984.

"Hauck Introduces The Complete Pulse Firing Concept" –Mar. 1986.

"Jet Firing With Pulse/Proportional Control (AM/FM)" –Ceram. Eng. Sci. Proc. 15[1] 167–175 (1994).

"Bricesco Random Pulse Firing" (undated).

"Trends In Firing Techniques For Ceramics Leading Up To Pulse Firing and Pulse Cooling For Ceramic Production" by Anderson, Wight, Walker –General Furnace Construction Pty. Ltd. (undated).

"The Use Of Small Truck Type Continuous Fast Firing Kilns For Ceramics" by Hulme, T.D. Wight and H.D. Wight –General Furnace Construction Pty. Ltd. (undated).

*Primary Examiner*—Noah P. Kamen

*Attorney, Agent, or Firm*—Synnestvedt & Lechner

[57] ABSTRACT

A kiln and method of firing kilns or the like in which high firing rate gas streams are introduced into the ware treating chamber in the form of pulsed jets and a continuous low firing rate gas stream is also introduced into the ware treating chamber for maintaining uniformity of temperature and atmosphere within the ware treating chamber. The time interval between the pulsed jets is controlled in accordance with the difference between a set predetermined temperature and the actual temperature in the ware treating chamber. Also disclosed is a burner for the kiln including coaxial primary and secondary nozzles for burning fuel. The primary nozzle burns fuel at a high rate and is pulsed intermittently while the secondary nozzle burns constantly at a low rate.

8 Claims, 5 Drawing Sheets

KILN CONSTRUCTION AND METHOD OF FIRING THE SAME

BACKGROUND OF THE INVENTION

This invention relates to a kiln construction and the method of firing kilns or the like. The invention is applicable to kilns (ceramic furnaces) or metallurgical furnaces.

In the firing of kilns it is essential that the heating be controlled so that the ware may be heated from room temperature to red heat and cooled down at a rate that will not destroy the ware. It is also desirable that the temperature gradient within the ware be maintained as low as possible as the ware is heated and cooled. If the temperature of the surface of the ware is changed too rapidly, a high temperature gradient is produced within the ware which may result in a defective product. Also it is desirable that the ware be heated and cooled uniformly throughout its surface area. A further requirement of good kiln operation is to maintain as close to a constant temperature as possible during the holding period.

One method of attempting to maintain a uniform holding temperature in the past has been to turn burners on and off rapidly with burners operating at a high velocity for a short duration and then turned down or off until heat demand is again required. This pulse technology, while an improvement over existing systems in many applications, still produced an unsatisfactory level of temperature excursions.

Batch firing of ceramic and other materials often requires a wide range of burner operation. In some processes, it is required to maintain temperatures of close to 100 degrees centigrade, while in others a temperature range in excess of 1700 degrees centigrade is required.

One other approach taken in the past was to use excess air type burners so that the low temperature requirements could be met. This approach consumes extra fuel, requires large exhaust fans to exhaust combustion air from the kiln and, to minimize air pollution, requires reheating of the exhaust by-products.

The pulse technology, as mentioned above, eliminates some of these problems, but can have high temperature excursions. However, a rapid pulse system, with short pulse durations, as low as one second, combined with a secondary burner with a constant low firing rate in the range of 1000 BTU's per hour and a main pulsed burner with the capacity of firing as high as 1,000,000 to 1,500,000 BTU's per hour has the capability of maintaining both the low and high temperature ranges with minimal temperature excursions.

With the foregoing in mind, it is therefore a principal object of the present invention to provide a pulse system for operating burners in a kiln to maintain holding or soaking temperatures within a preset narrow range of temperature with limited acceptable variations over a long holding period.

A further object of the present invention is to provide a pulse system for operating burners in a kiln in which burners throughout the length of the kiln may be individually controlled and pulsed sequentially throughout the length of the kiln to reduce pressure spikes in the kiln and maintain a uniform temperature within the kiln.

Another object of the present invention is to provide a novel burner for a kiln pulse system utilizing a two stage nozzle in which the first stage is constantly on during operation of the kiln with a low burn rate in the range of about 1000 BTU/hour and a second stage which can be pulsed on for a duration of approximately one second at a burn rate of anywhere from 20,000 to 1,500,000 BTU/hour and then off for variable periods of from one to ten or more seconds depending on the temperature requirements.

A still further object of the present invention is to provide a burner for a kiln pulse system which is durable, efficient and reliable.

Still a further object of the present invention is to provide a pulse system for operating a kiln in which multiple burners are individually controlled in response to feedback from multiple thermocouples in the kiln by a programmable controller responsive to measured conditions within the kiln.

SUMMARY OF THE INVENTION

It is, as set forth above, the general object of the invention to provide a kiln and an improved method of firing kilns or the like, which method maintains temperature within the kiln within closely maintained pre-programmed ranges.

The invention includes a method of firing kilns having a ware treating chamber with a plurality of burners for introducing ware treating gas streams into a treating chamber. Fuel is supplied to a primary burner nozzle in the form of short pulses at predetermined intervals while a secondary burner nozzle provides burning fuel continuously at a slow rate. The temperature in the treating chamber is monitored continuously and pulsing of the primary burner is controlled in accordance with deviation from a preset treatment cycle.

DESCRIPTION OF THE PREFERRED EMBODIMENT

Figure 1:
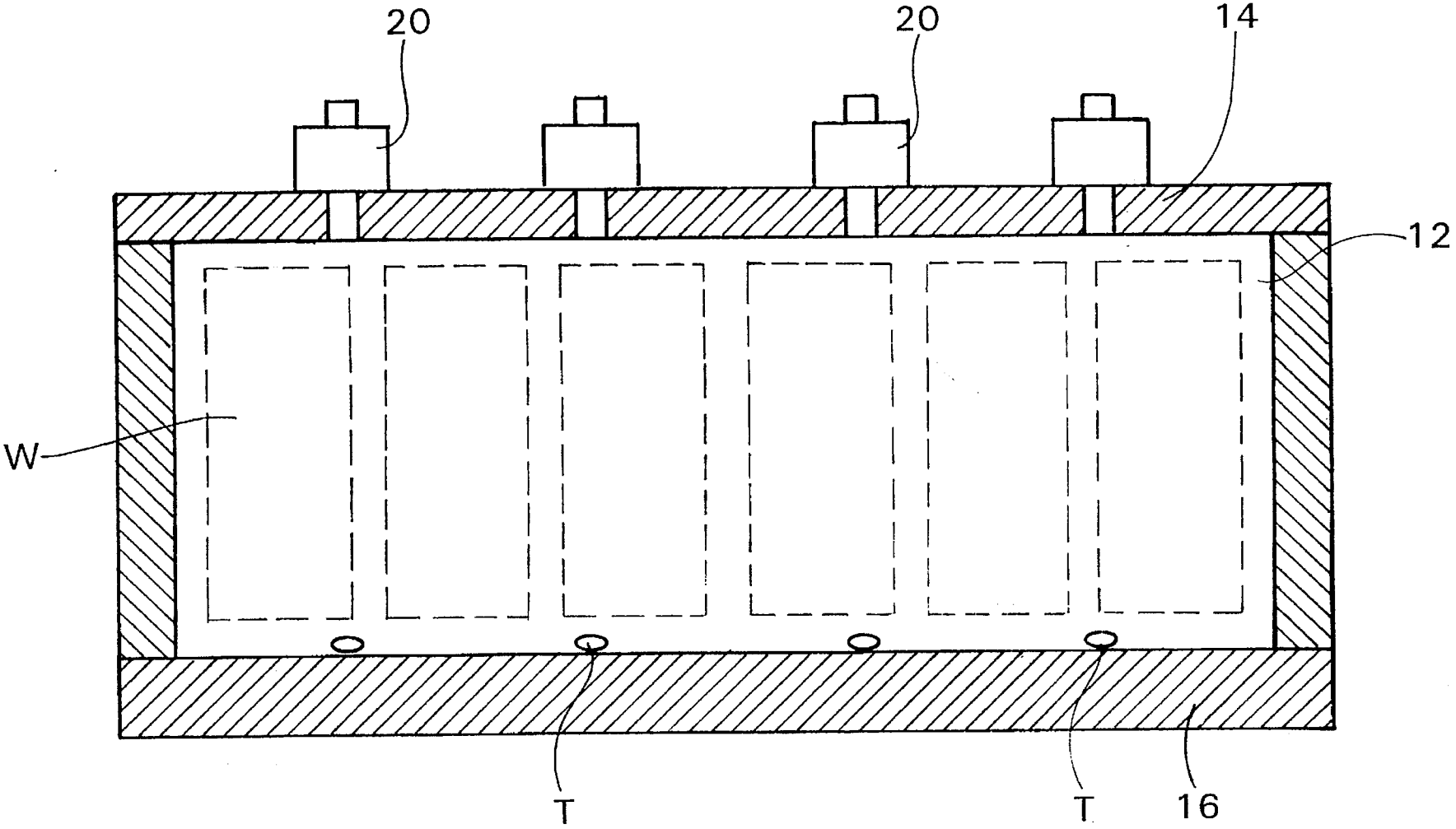
FIG. 1 is a schematic plan of a kiln embodying the present invention.

In FIG. 1 of the drawings there is shown schematically, a horizontal section through a continuous kiln which includes apparatus for the firing of a kiln in accordance with the method of the invention. The continuous kiln is indicated at 10 and defines a longitudinal tunnel or kiln ware treating chamber 12 defined by a suitable refractory material. The kiln structure comprises a roof (not shown) supported on vertical side walls 14 and 16. Continuous kilns of this type are well known in the art.

The bottom wall of the kiln supports the usual kiln cars 18 which ride on conventional rails. The kiln cars 18 are moved through the kiln by conventional means and are provided with a horizontal platform for supporting the ware indicated at W. As is conventional, the ware W is arranged on the platform so as to provide fire lanes extending transversely across the kiln chamber. There is provided, along the length of the kiln, a plurality of individual firing burners 20 of the present invention spaced longitudinally along the kiln at uniform intervals. Opposite each burner 20 are individual temperature sensing means, such as thermocouples to sense and transmit the temperature of the kiln chamber at its location.

Figure 2:
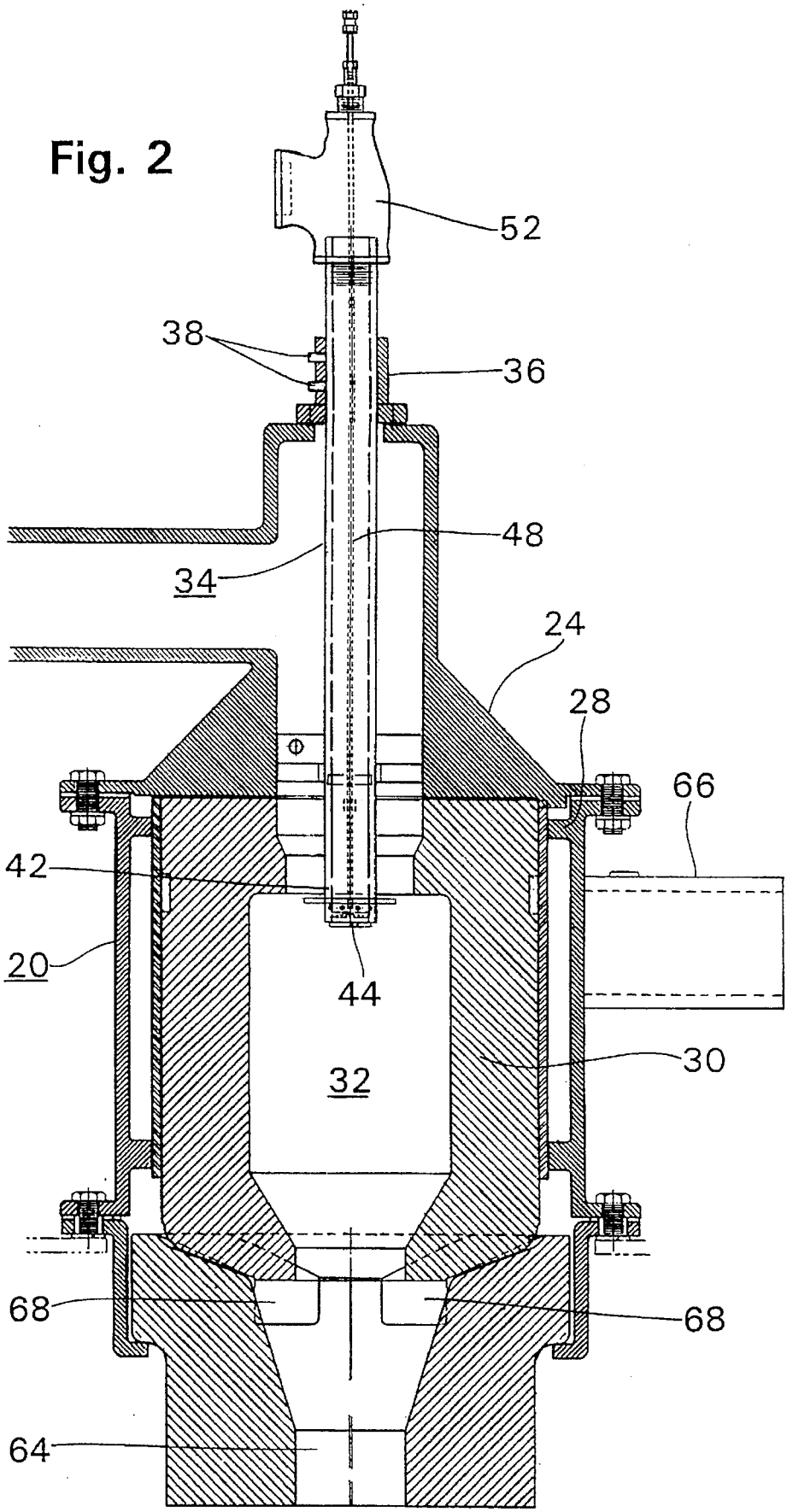
FIG. 2 is a longitudinal sectional view of a burner utilized in the present invention.
Figure 3:
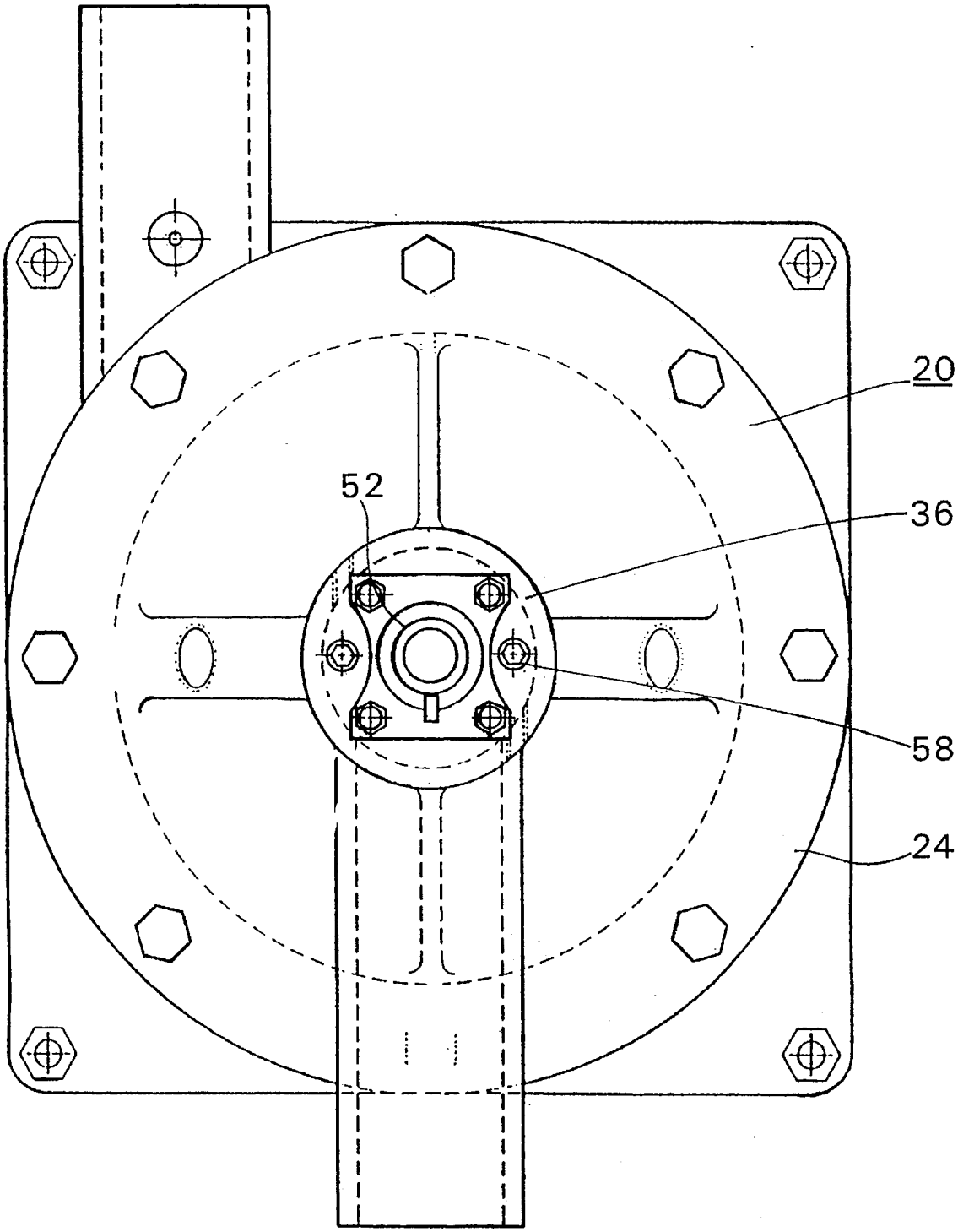
FIG. 3 is a rear view of the burner of FIG. 2.

Burners 20, constructed and operated in accordance with the present invention, are illustrated in FIGS. 2 and 3. Each burner 20 includes an outer shell 22 bolted or otherwise secured to a fuel and air intake manifold 24. Within the outer shell of each burner 20 is a support sleeve 26, spaced uniformly from the outer shell by a pair of spider members 28, 28. The support sleeve 24 carries a refractory block 30 which forms a combustion chamber 32.

Figure 5:
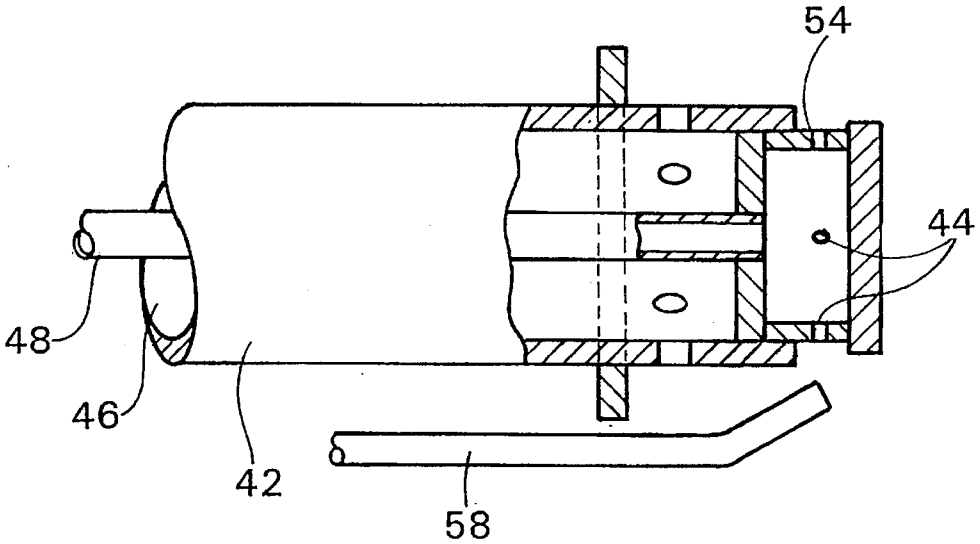
FIG. 5 is an enlarged view, partially in section, of the end of the burner nozzle.

Extending longitudinally through the fuel and air manifold 24 and terminating within the combustion chamber 32, is the fuel-air burner nozzle 34 of the present invention. One form of this burner nozzle is illustrated in FIGS. 2 and 5 of the drawings. The burner nozzle is mounted longitudinally of the fuel and air intake and terminates at the entrance to the combustion chamber 32. A burner tube support 36 secured to the rear of the fuel and air intake 24 having a pair of adjusting screws 38,38 mounts the burner nozzle for adjustable movement relative to the combustion chamber.

In accordance with the present invention, the fuel-air burner nozzle 34 comprises a primary burner 42 and a secondary burner 44. In the embodiment of the invention illustrated, the burner nozzle 34 includes an outer cylindrical tube 46, received within the burner tube support 36 which serves as the conduit for the primary fuel supply, and an inner cylindrical tube 48 which serves as the conduit for the secondary fuel supply. The outer tube 46 is connected through an elbow fitting 52 to an intermittent primary gas supply, more fully set forth hereafter, and the tube 48 for the secondary gas supply extends through the fitting 52 and is connected to a secondary gas supply.

As illustrated in FIG. 5, the end of the outer tube 46 is plugged by a hollow cylindrical fitting 54 into which fuel from the secondary gas supply tube 48 is fed. Immediately upstream of the fitting 54 are a plurality of large discharge openings 56 in the tube 46 which form the primary burner 42. Combustion air is supplied to the secondary burner 44 by means of the air supply tube 58 extending parallel to the tube 48 and terminating in a discharge tip adjacent the secondary burner. If desired, an air shield 60 may be provided surrounding the tube 46 adjacent the primary burner discharge openings 56 to shield the primary burner from direct flow of the primary combustion air.

Referring again to FIG. 2, primary combustion air, at a stoichiometric rate relative to fuel supply, is introduced through an inlet to the fuel and air intake 24 surrounding the fuel supply tube 48 and enters the combustion chamber 32 where combustion is completed. The products of combustion exit the combustion chamber into a diffusion chamber where they are mixed with diffusion air. The diffusion air is introduced into the space between the outer shell 22 and the refractory block support sleeve 26 through an inlet 66, passes through the forward spider 28 and then is supplied to the diffusion chamber 64 through a series of tangential slots 68 at the entrance to the diffusion chamber 64. These products are then discharged into the kiln ware treating chamber 12.

Figure 4:
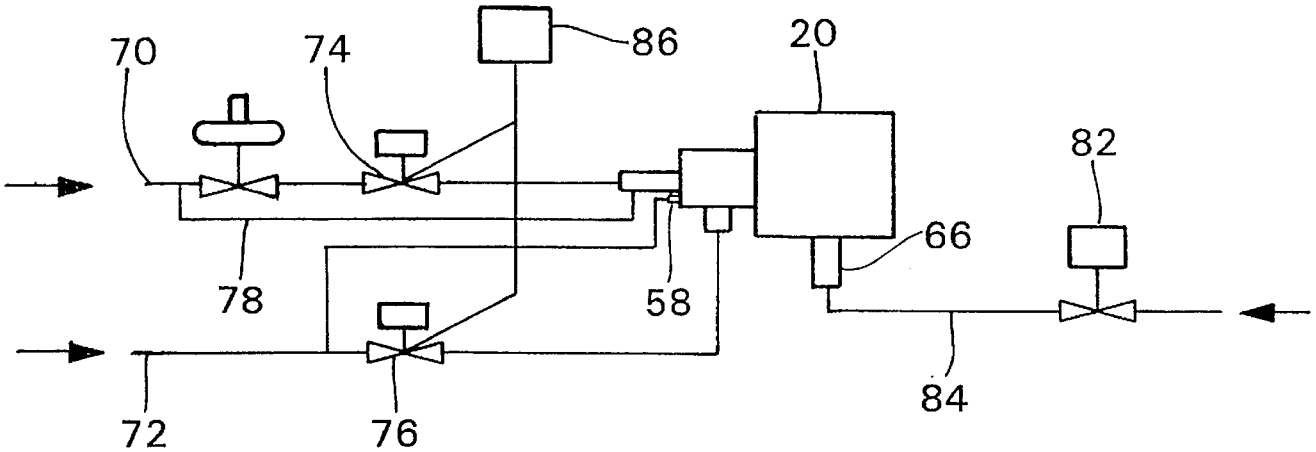
FIG. 4 is a schematic plan of the control means for controlling air and fuel flow to one of the multiple burners in the kiln of FIG. 1.

FIG. 4 illustrates schematically one form of a control system for controlling fuel and fuel and air supply to one of the multiple burners shown in FIG. 1 and for controlling pulsing of the main or primary burner. Fuel, such as natural gas, from a common source for all burners 20 is fed through a fuel supply conduit 70 while filtered combustion air is supplied by blowers, not shown, to the combustion air supply conduit 72. Fuel and combustion air pulse valves 74 and 76, respectively, are provided in the fuel and air supply conduits 70 and 72 leading to the primary burner 20. Fuel for the secondary burner 44 bypasses the fuel pulse valve 74 through the secondary fuel supply conduit 78 as does secondary combustion air for the secondary air supply 58. Diffusion air is supplied from a filter and blower through a pulse valve 82 and conduit 84 to the diffusion air inlet 66.

The primary fuel and combustion air is controlled so that primary fuel is burned at a rate of about 1,000,000 to 1,500,000 BTU's per hour. Similarly, the secondary burner is designed to burn fuel at the rate of approximately 1,000 BTU's per hour. A solenoid controlled pulse valve actuator 86 is provided to pulse the primary fuel and air pulse valves on simultaneously for a period of approximately one to one and one-half seconds, depending on kiln temperature requirements. The off period is controlled by a data processor in accordance with a pre-programmed temperature cycle, more fully described hereafter. Secondary air may be pulsed in sequence with the primary air as desired.

In accordance with the present invention, a pre-programmed temperature cycle is provided and control means are provided for maintaining automatically a desired temperature in the firing zone. To this end, the thermocouples or pyrometers T are mounted in the wall 16 opposite its associate burner in the side wall 14 to sense the temperature in the zone to be controlled. In the operation of the method in accordance with the invention, high velocity gas streams in the form of pulsed jets are introduced into the kiln chamber 12 through fire lanes formed by the ware to provide an effective flow pattern of the gases. Along with the control means of the present invention, this enables the achievement of the desired result of uniform temperature and uniform atmosphere conditions throughout the kiln. Alternatively, the kiln can be zoned with a group of burners in each zone to maintain predetermined conditions within a zone in the kiln.

Figure 6:
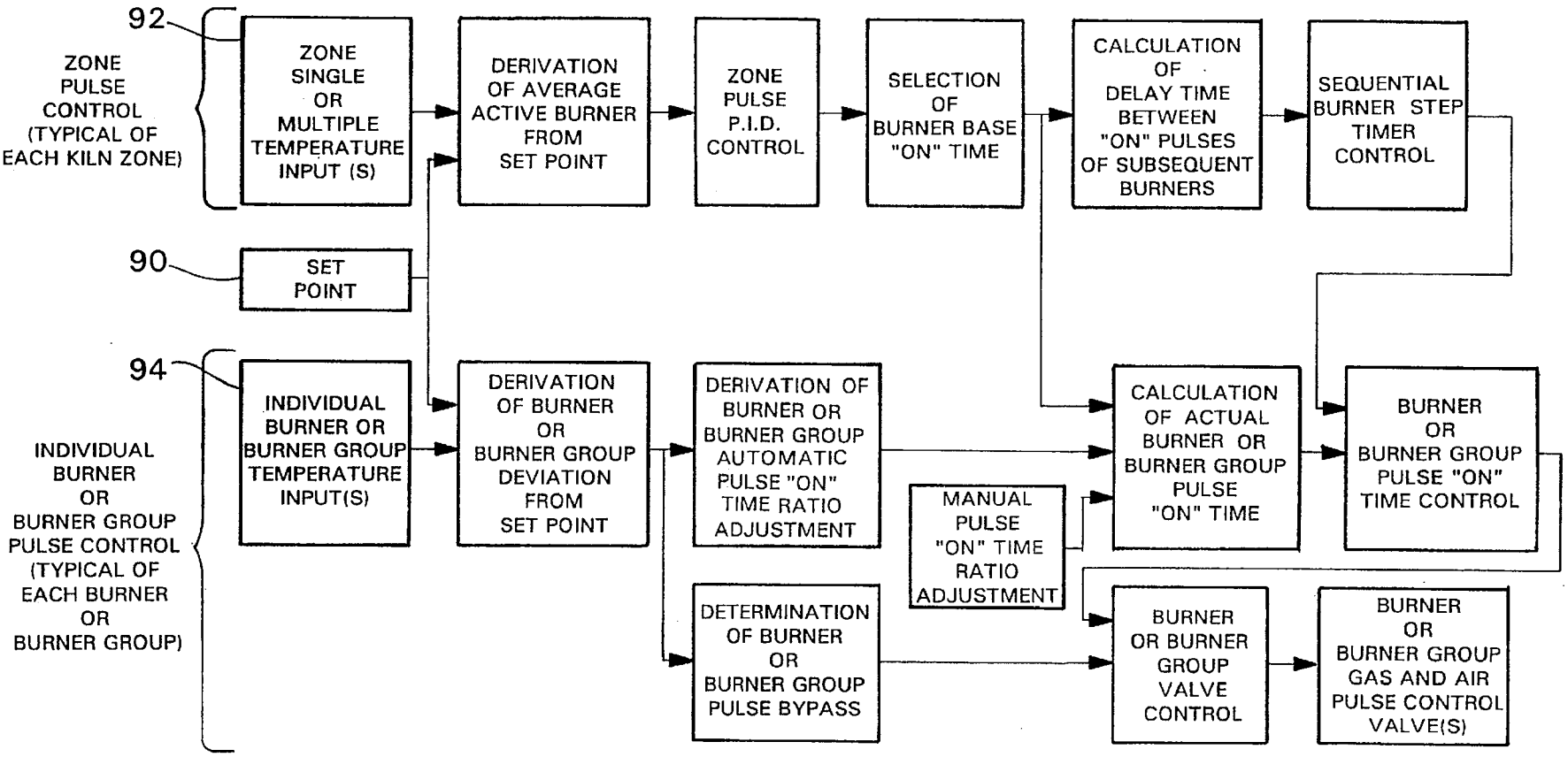
FIG. 6 is a flow diagram of the system for controlling the burners in the kiln to follow a pre-programmed product treatment cycle.

The control means or system for maintaining the desired temperature cycle is illustrated in the flow diagram of FIG. 6. The temperature set point, which may vary with time according to the program cycle, is provided to the system at 90. Zone temperature inputs are fed to the system at 92 and individual burner temperature inputs from the thermocouples are provided at 94. The input temperatures from the individual zones will be one temperature input for each zone, while, if individual burners are being monitored, the input at 94 will be one temperature input for each individual burner.

As shown in the flow diagram, the temperature inputs are first compared with the set point and a determination is made of any deviation from the set point. Thereafter, processing of the temperature inputs is continued as shown in the flow diagram of FIG. 6 to constantly monitor the temperature input and modify the burner base "on" time and time between "on" pulses. As shown, there is the calculation of the required burner on time and the delay time between pulses to maintain the desired temperatures. Also, the burners are activated sequentially and the sequential time control for the burners is determined. Finally, signals are generated for the burner or burner group valve control and the signals are transmitted to each valve actuator 86 by a signal transmitter 96.

In summary, a plurality of burners are controlled sequentially, either individually or in zones, if zone control is desired, according to a predetermined temperature control program. Temperatures are continuously monitored and changes made in the control of the burners to follow the desired temperature cycle with minimal temperature excursions. The individual burners each have a continuously burning secondary burner, burning as a slow rate of approximately 1,000 BTU's per hour and a pulsed primary burner, burning with a one to one and one-half second pulse at a rate of 1,000,000 to 1,500,000 BTU's per hour. This provides a closely monitored temperature control with minimal temperature variations.

While a particular embodiment of the present invention has been illustrated and described herein, it is not intended to limit the invention to such a disclosure and changes and modifications may be incorporated and embodied therein with the scope of the following claims.

What is claimed is:

1. A method of firing kilns or the like having a ware treating chamber defined by a wall containing a plurality of burners for introducing ware treating gas streams into the ware treating chamber, each burner having a primary burning nozzle and a secondary burning nozzle, comprising:

supplying fuel to said primary nozzle from a high pressure source in the form of pulses for short periods of time and at predetermined intervals to introduce high velocity pulsed streams of combustion products into the ware treating chamber;

supplying fuel to said secondary nozzle from a high pressure source continuously to introduce streams of combustion products into the ware treating chamber;

continuously monitoring the temperature in the ware treatment chamber at each burner over a period of time by providing a set temperature point for each period of time;

determining the deviation of the actual temperature from the set temperature point; and controlling the delay between pulses of fuel to the primary burning nozzles to follow a preset temperature control cycle.

2. The method of claim 1 wherein combustion air is supplied to the primary burning nozzle, said combustion air being pulsed simultaneously with pulsing of said fuel.

3. The method of claim 2 wherein combustion air is supplied to said secondary burning nozzle continuously.

4. The method of claim 2 wherein said pulsed fuel supply to said primary nozzle is supplied to burn at a continuous rate of approximately 1,000,000 to 1,500,000 BTU's per hour.

5. The method of claim 4 wherein fuel is supplied to said secondary nozzle to burn at a rate of approximately 1,000 BTU's per hour.

6. The method of claim 1 wherein the duration of the pulses of said primary fuel supply are in the range of approximately one to one and one-half seconds.

7. The method of claim 1 wherein a plurality of burners are controlled simultaneously by monitoring the temperature in the ware treatment chamber at each such burner;

determining the deviation of the actual temperature from the set point at each such burner;

and controlling the delay between pulses of fuel for the primary burning nozzle of each such burner separately in accordance with the temperature deviation at each such burner.

8. The method of claim 1 wherein the fuel supply to the primary burning nozzle of each burner of the plurality of burners is pulsed sequentially.

* * * * *